United States Patent [19]

Lamb et al.

[11] Patent Number: 4,457,319

[45] Date of Patent: Jul. 3, 1984

[54] CIGARETTE FILTER

[75] Inventors: Charles G. Lamb; Harry S. Porenski, both of Louisville, Ky.

[73] Assignee: Brown & Williamson Tobacco Corporation, Louisville, Ky.

[21] Appl. No.: 391,024

[22] Filed: Jun. 22, 1982

[51] Int. Cl.[3] ..... A24D 1/04; A24D 3/04

[52] U.S. Cl. ..... 131/336; 131/339; 131/340; 131/363

[58] Field of Search ..... 131/362, 363, 336, 339, 131/340, 341

[56] References Cited

U.S. PATENT DOCUMENTS 2,558,127 6/1951 Downs ..... 131/363

4,331,166 5/1982 Hale ..... 131/90

*Primary Examiner*—Vincent Millin

*Attorney, Agent, or Firm*—Charles G. Lamb

[57] ABSTRACT

A filter for a cigarette which includes a centrally disposed generally conical baffle at the mouth end thereof with its conically shaped wall diverging in the general direction of the flow of smoke through the filter to divert the smoke exiting from the center of the filter when in use. The baffle is substantially impervious to smoke and forces the smoke leaving the filter in a direction generally angularly outward from the periphery of the filter. Ventilating air grooves can also be provided in the filter to direct ventilating air at the mouth end of the filter to provide mixing of the exiting smoke and ventilating air at the mouth end of the filter.

14 Claims, 6 Drawing Figures

CIGARETTE FILTER

BACKGROUND OF THE INVENTION

1. Field of the Invention

This invention relates to filters for cigarettes. In one aspect, it relates to a filter with a flow directing baffle at the mouth or outlet end of a filter. In another aspect, the invention relates to a filter for a cigarette having means to direct the flow of the smoke exiting the filter in a direction generally at an angle outwardly from the mouth end of the filter. In a further respect, the invention relates to a cigarette filter of the class described having ventilating air directing grooves formed therein for directing ventilating air to the mouth end of the filter.

2. Description of the Prior Art

In the manufacture of filters for cigarettes which are in the low and ultra-low tar (1 mg. to 10 mg.) category, most of the filters use a large quantity of ventilating air which is introduced into the filter to reduce the tar in the smoke stream through dilution. In most of the commercially available products, the smoke is concentrated in the center of the filter and, during smoke draw, enters the smoker's mouth horizontally or longitudinally, thereby missing many of the "taste buds"; thus, delivering very little taste.

There have been suggested special type filters for cigarettes wherein the filters are provided with means to alter the flow of the smoke stream passing therethrough in anticipation of improving the efficiency of the filter. U.S. Pat. No. 2,833,289 and U.S. Pat. No. 3,496,945 are examples of filters which teach the restriction of smoke flow in the filter and then mixes the smoke with ventilating air just prior to exiting from the filter at the mouth end thereof. Another example is U.S. Pat. No. 2,849,005 which teaches a patent image of an emblem being formed on the exposed end of the filter which is developed by the smoke passing therethrough during use. Many other examples of mixing smoke with ventilating air are known in the art, but none teach the concept of smoke being diverted from the center as it exits the filter. Italian No. 655,251 teaches a baffle in the shape of a disc at the outlet end of a filter and U.S. Pat. No. 4,256,122 teaches the use of ventilating air mixing in separate channels along the outer surface and mixing with the exiting smoke in the center of the filter in the smoker's mouth.

SUMMARY OF THE INVENTION

The present invention advantageously provides a straight forward arrangement of a filter for a cigarette which in one form achieves normal cigarette pressure drop with a low to moderate efficiency filter. The present invention further provides a cigarette filter for directing the flow of the smoke exiting the filter in a generally angularly outward direction from the mouth end of the filter. The present invention even further provides a filter for a cigarette utilizing a baffle on the mouth end of the filter for directing the flow of smoke in a generally angularly outward direction. The present invention also provides a ventilated cigarette filter utilizing grooves in the filter rod and a baffle at the mouth end of the filter.

Various other features of the present invention become obvious to those skilled in the art upon reading the disclosure set forth hereinafter.

More particularly, the present invention provides a filter for a cigarette comprising:

A porous filter rod of cylindrical configuration having opposed inlet and outlet ends; and, generally conically shaped flow directing means at the outlet end of the filter rod diverging in the general direction of the flow of smoke through the filter rod for directing the smoke leaving the mouth end of the filter in a generally angularly outward direction of the filter.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
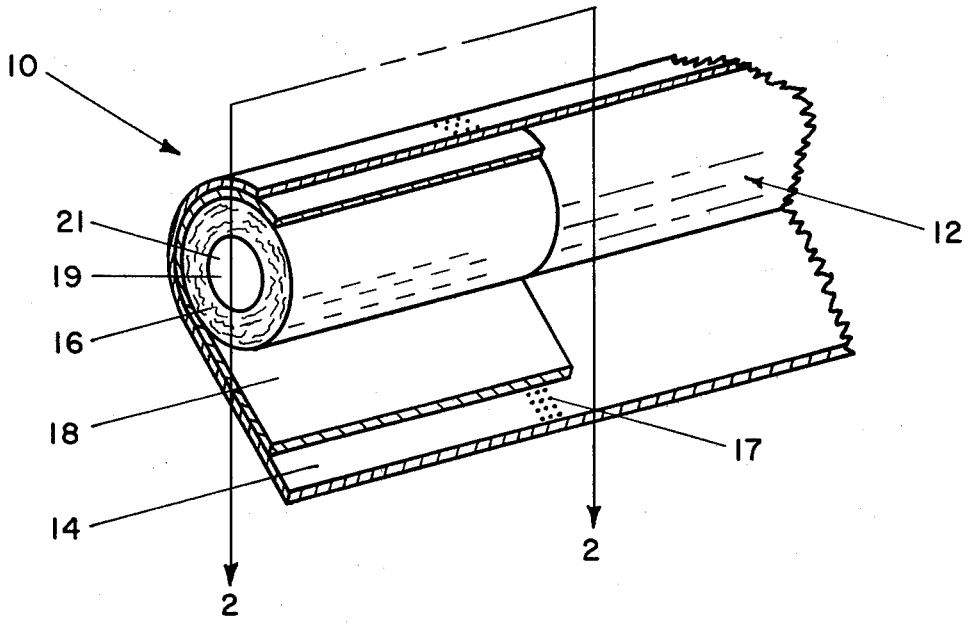
FIG. 1 is a perspective view of one preferred filter of the present invention attached to a cigarette with the plug wrap and tipping material shown in unwrapped condition.
Figure 2:
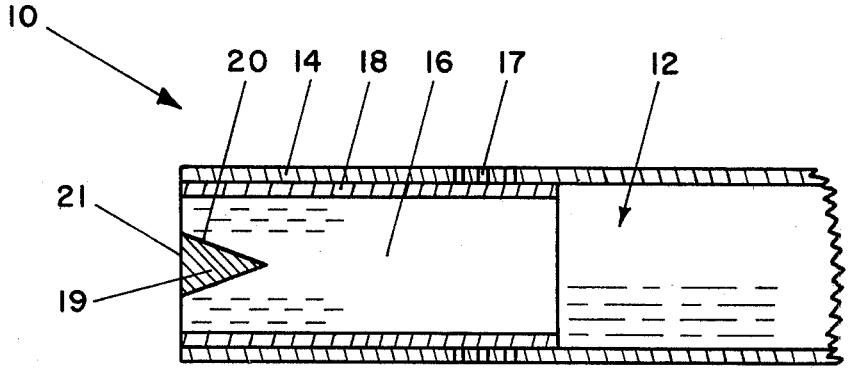
FIG. 2 is a sectional view of the filter of FIG. 1 taken along the lines 2—2.

In FIGS. 1 and 2, a filter 10 is shown attached to a cigarette column 12 by a tipping paper or material 14. The filter 10 includes a cellulose acetate filter rod 16, or any other filter made from fibrous or foam materials for tobacco smoke which may be known in the art, circumscribed by a wrapping material 18, commonly referred to as plug wrap. The filter rod 16 is generally of cylindrical configuration having opposed inlet and outlet ends. The plug wrap 18 may be porous or non-porous, and also the plug wrap may include outer surfaces of foam material which are integral with the filter element as well as wrapping material which is not integral with the filter plug. Furthermore, in the use of some filter materials, it may not even be necessary to use a plug wrap. In most conventional low and ultra-low tar cigarettes, the plug wrap 18 is porous and the tipping material 14 is provided with a plurality of ventilating air openings 17 therein to provide ventilating air into the filter element 16 to dilute the smoke stream passing therethrough.

On the mouth end or the smoke outlet end of the filter 10 is an obstruction or baffle means 19 which is generally centrally disposed with and embedded in the filter rod 16. As shown, the baffle means 19 is generally conically shaped and positioned with its conically shaped wall 20 diverging in the general direction of the flow of smoke through the filter rod to direct the smoke leaving the filter in a direction generally angularly outward from the mouth end of the filter. In most cigarettes, and particularly those of the so-called low or ultra-low tar variety, nearly all of the smoke exiting the filter exits in a longitudinal stream at the center with very little exiting at the periphery. In order to create a flow restriction at the mouth end of the cigarette filter so that the smoke is diverted, not longitudinally, but generally angularly outward from the periphery of the filter, the obstruction or baffle means 19 is provided. In the embodiment of FIGS. 1 and 2, the baffle means is exemplified as being fabricated of a substantially smoke impervious material and is located at the central area of the mouth end or outlet end of the filter rod to make the central area substantially impervious to smoke. The base end 21 of the conical baffle 19 covers usually from 10% to 80% of the cross-sectional area of the filter. It has been found that where a large amount of ventilating air has been added to the smoke stream in the filter, thereby diluting the smoke considerably, the larger the base end 21 of the baffle must be in order to obtain this lateral or turbulent movement of the smoke stream leaving the filter.

Figure 3:
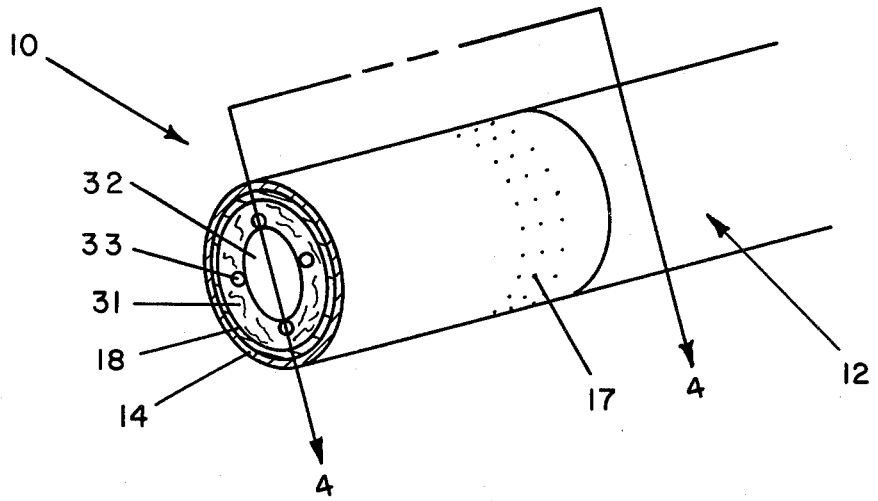
FIG. 3 is a perspective view of another preferred filter of the present invention attached to a cigarette.
Figure 4:
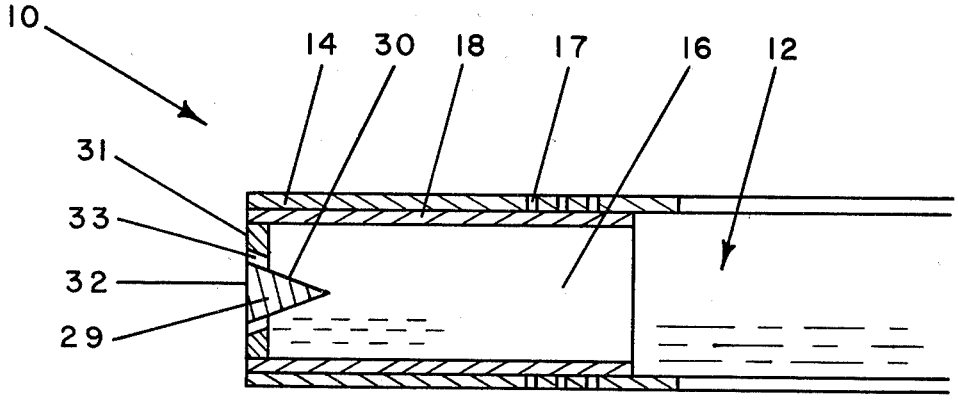
FIG. 4 is a sectional view of the filter of FIG. 3 taken along the lines 4—4.

FIGS. 3 and 4 illustrate a solid baffle 29 of plastic. The baffle 29 comprises a centrally disposed generally conically shaped section 30 embedded in the filter rod 16 and positioned with its conically shaped wall diverging in the general direction of the flow of smoke through the filter element 16. The baffle 29 is illustrated as including a circumferential flange 31 extending at an angle outward from the periphery of the base end 32 of the conically shaped section 30. The base end 32 and circumferential flange 31 substantially cover the entire outlet or mouth end of the filter element 6 and are embedded into the filter element 16. A plurality of apertures 33 are provided circumambiently of the periphery of the conical section 30 of the baffle 29 through the circumferential flange 31 to provide means for letting the smoke out. Preferably, each of the apertures 33 are oriented with the longitudinal axis of the apertures 33 at an angle to the longitudinal axis of the filter element 16 and inclined away from the longitudinal axis of the filter element in the general direction of the flow of smoke therethrough. As shown, each of the apertures 33 are inclined at an angle generally corresponding to the slope of the conically shaped section 30.

Figure 5:
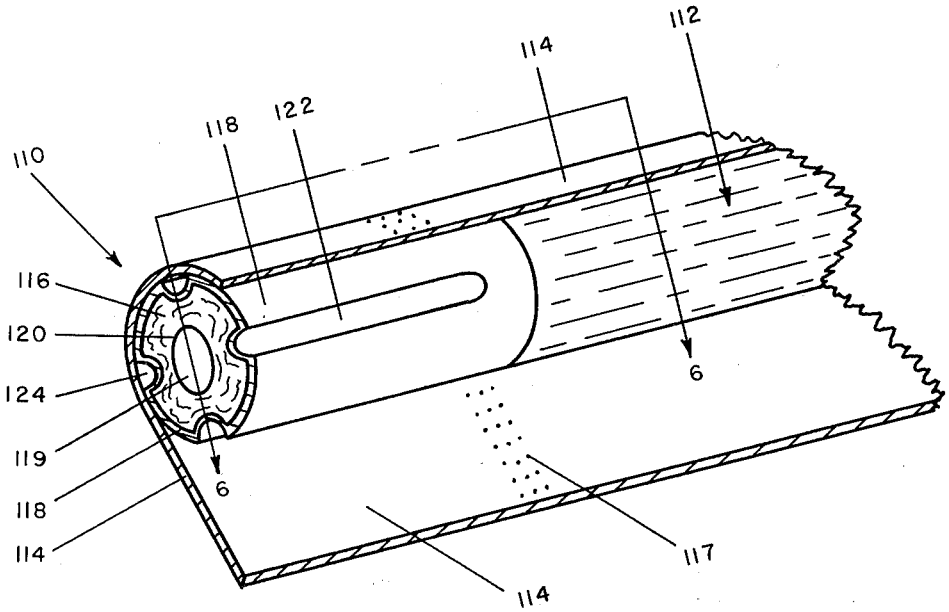
FIG. 5 is a perspective view of another preferred filter of the present invention attached to a cigarette; and, FIG. 6 is a sectional view of the filter of FIG. 5 taken along the lines 5—5.
Figure 6:
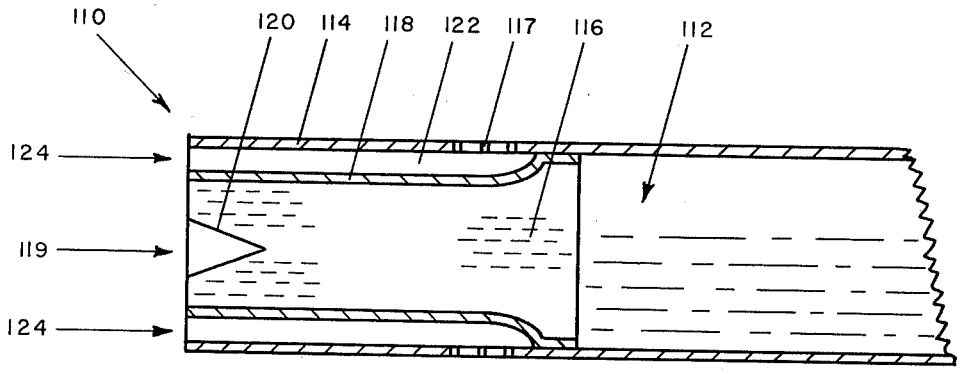

In FIGS. 5 and 6, a filter 110 is shown attached to a cigarette column 112 by a tipping paper or material 114. Thefilter 110 includes a cellulose acetate filter rod 116, or any other filter made from fibrous or foam material for tobacco smoke which may be known in the art, circumscribed by a wrapping material 118, commonly referred to as plug wrap. The filter rod 116 is generally cylindrical in configuration and has opposed inlet and outlet ends. The plug wrap 118 is air impermeable and the tipping material 114 is air permeable. The tipping material may be porous or, as illustrated, non-porous, and provided with a plurality of ventilating air openings 117 therethrough.

The filter 110 further comprises a plurality of grooves 122 formed in the air impermeable plug wrap 118 and embedded into the filter rod 116. Each of the grooves 122 is open at one of its ends 124 to the mouth end of the filter rod 116 of the filter 110, and extends therefrom in a generally longitudinal direction of the filter rod 116 for a distance less than the length of the filter rod 116. As shown in FIG. 5, four grooves 122 are equally spaced from each other around the circumference of the filter rod 116.

The wrapped filter rod 116 is attached to the cigarette column 112 by the tipping material 114 which circumscribes the wrapper covered filter rod 116 to form the filter cigarette. As previously mentioned, the tipping material 114 is air permeable so that ventilating air will flow through and into the grooves 122. To this end, the ventilating air openings 117 in the tipping material 114 communicate with the grooves 122 in the wrapped filter rod 116 to provide for ventilating air flow into the grooves 122. Ventilating air will not flow into the filter rod 116 due to the air impermeable plug wrap 118, and likewise, smoke will not flow from the filter rod 116 into the grooves 122. Therefore, only ventilating air will flow in the grooves 122.

With continued reference to FIGS. 5 and 6, an obstruction or baffle means 119 is located at the mouth end or smoke outlet end of the filter 110. The baffle means 119 is generally centrally disposed within the filter rod 116. As shown, the baffle 119 is generally conical in shape and positioned with its conically shaped wall 120 diverging in the general direction of the flow of smoke through the filter rod 116 to direct the smoke leaving the filter in a direction generally angularly outward from the mouth end of the filter. The base end of the conical baffle 119 covers usually from about 10% to 30% of the cross-sectional area of the filter. It is realized that the optimum base area will depend on the size of the grooves, velocity of fluid flowing through the grooves, as well as number of grooves. As discused in regard to the filter of FIGS. 1–2 and 3–4, the baffle 119 may be fabricated of a substantially smoke impervious material such as plastic. However, as shown in FIGS. 5 and 6, the baffle means comprises a depression formed in the filter material of the filter rod 116 and has its conical wall 120 rendered smoke impermeable by, for example, heat treatment or chemical treatment to seal the pores of the filter material. Examples of various chemicals suitable for this purpose are ethylcellulose, sodium CMC and methyl cellulose.

When a smoker draws on the mouth end of the filter while smoking the cigarette, ventilating air is drawn through the ventilating air openings 117 in the tipping material 114 into the grooves 122 and travels along the grooves directly to the open ends 124 of the grooves at the mouth end of the filter rod 116. Concurrently, smoke is drawn through the filter rod 116. The baffle means 119 creates a flow restriction at the mouth end of the filter so the smoke is diverted generally angularly outward from the periphery of the filter generally into the path of the ventilating air leaving the open ends 124 of the ventilating grooves 122. Eddy currents created in the ventilating air streams leaving the open ends 124 of the grooves 122 disperse the smoke in the smoker's mouth to increase the perceived taste of the cigarette.

It should be understood that, while the generally conical shape of the baffles is illustrated as being a right circular cone, it can also be, for example, truncated or hemispherical.

It will also be realized that various changes may be made to the specific embodiments shown and described without departing from the principles and scope of the present invention.

What is claimed is:

1. A filter for a cigarette comprising:

a porous filter rod of cylindrical configuration having opposed inlet and outlet ends; and, generally conically shaped flow directing means with its conically shaped portion inserted into said porous rod at the outlet end of the filter rod for diverging the smoke in the mouth end of the filter and the smoke leaving the mouth end of the filter in a generally angularly outward direction of the filter rod.

2. The filter of claim 1, wherein said flow directing means comprises:

means defining a depression formed in the outlet end of said filter rod; and, means rendering the wall of said depression smoke impermeable.

3. The filter of claim 1 wherein the flow directing means is a smoke impervious baffle embedded into the mouth end of the filter rod.

4. The filter of claim 3 wherein the base end of the conical baffle covers from 10% to 80% of the cross-sectional area of the filter rod.

5. The filter of claim 1 wherein the generally conical flow directing means is centrally disposed of the filter rod.

6. The filter of claim 1 wherein the generally conically shaped flow directing means comprises a conically shaped section, and a circumferential flange extending generally angularly outward from the periphery of the base end of the conically shaped section, the base end and circumferential flange substantially covering the mouth end of the porous filter rod, and a plurality of apertures disposed circumferentially of the conical section through the circumferential flange.

7. The filter of claim 6, wherein the longitudinal axis of each of the apertures is inclined away from the longitudinal axis of the filter rod in the general direction of the flow of smoke through the filter rod.

8. The filter of claim 7, wherein the apertures are inclined at an angle to the longitudinal axis of the filter rod at an angle generally corresponding to the slope of the conically shaped section.

9. The filter of claim 1 including a filter rod wrapper extending longitudinally of and circumscribing the rod leaving the opposed ends in flow-through communication.

10. The filter of claim 9 wherein the filter rod wrapper is impermeable to smoke.

11. The filter of claim 10, further comprising said wrapper being formed with at least one groove embedded into said filter rod, said at least one groove being open at the outlet end of said filter rod and extending therefrom in a generally longitudinal direction of said filter rod for a distance less than the length of said filter rod.

12. The filter of claim 11 wherein the base end of the conical baffle covers from 10% to 30% of the cross-sectional area of the filter.

13. The filter of claim 9 wherein the filter rod wrapper is air permeable.

14. The filter of claim 1, further comprising said filter rod being formed with at least one groove embedded into said filter rod, said at least one groove being open at the outlet end of said filter rod and extending in a generally longitudinal direction of said filter rod for a distance less than the length of said filter rod, and the embedded wall of said at least one groove being smoke impermeable.

* * * * *